US008833688B2

(12) United States Patent
Koop et al.

(10) Patent No.: US 8,833,688 B2
(45) Date of Patent: Sep. 16, 2014

(54) MIXING SHAFT FOR THOROUGH MIXING AND COMMINUTING OF FOOD PRODUCTS

(75) Inventors: Franz Koop, Wunstorf (DE); Gerhard Brockmann, Aerzen (DE); Regina Hermann, Bad Pyrmont (DE)

(73) Assignee: Stephan Machinery GmbH, Hameln (DE)

( * ) Notice: Subject to any disclaimer, the term of this patent is extended or adjusted under 35 U.S.C. 154(b) by 302 days.

(21) Appl. No.: 10/567,133

(22) PCT Filed: Aug. 2, 2004

(86) PCT No.: PCT/DE2004/001729

§ 371 (c)(1),
(2), (4) Date: Jun. 13, 2006

(87) PCT Pub. No.: WO2005/014152

PCT Pub. Date: Feb. 17, 2005

(65) Prior Publication Data

US 2007/0125894 A1 Jun. 7, 2007

(30) Foreign Application Priority Data

Aug. 2, 2003 (DE) ..... 103 35 552

(51) Int. Cl.
*B02C 17/18* (2006.01)
*B01F 7/00* (2006.01)

(52) U.S. Cl.
CPC ..... *B01F 7/00016* (2013.01); *B01F 7/00033* (2013.01); *B01F 7/00666* (2013.01); *B01F 7/00141* (2013.01); *B01F 7/00041* (2013.01); *B01F 7/001* (2013.01)
USPC ..... 241/300; 241/172; 366/325.2

(58) Field of Classification Search
USPC ..... 241/172, 101.8, 277, 282.1, 282.2, 300; 366/343, 325.1, 325.2, 325.4
See application file for complete search history.

(56) References Cited

U.S. PATENT DOCUMENTS

| | | | | |
|---|---|---|---|---|
| 2,852,238 | A * | 9/1958 | Varkony | 366/308 |
| 3,622,129 | A * | 11/1971 | Mazowski | 366/247 |
| 4,651,935 | A * | 3/1987 | Samosky et al. | 241/65 |
| 4,915,307 | A * | 4/1990 | Klimaschka et al. | 241/65 |
| 5,356,701 | A * | 10/1994 | Wei et al. | 442/6 |
| 5,379,952 | A * | 1/1995 | Geiger | 241/65 |
| 6,431,478 | B1 * | 8/2002 | Reed et al. | 241/65 |
| 6,548,612 | B2 * | 4/2003 | Smith et al. | 526/255 |
| 2002/0035699 | A1 | 3/2002 | Crosbie | |
| 2002/0054578 | A1 | 5/2002 | Zhang et al. | |

* cited by examiner

*Primary Examiner* — Mark Rosenbaum
(74) *Attorney, Agent, or Firm* — Horst M. Kasper

(57) ABSTRACT

A mixing shaft (1) is disclosed, used in an assembly (2) of a unit for thorough mixing and comminuting of food products. The mixing shaft (1) comprises a steel core (3), surrounded by a one-piece plastic coating (6) with mixing elements (4). In order to retain the plastic coating (6) on the steel core (3) of the mixing shaft (1), the surface of the steel core (3) has a structured embodiment. The plastic coating (6) is applied to the mixing shaft (1) by means of a particular isostatic pressurized application method.

14 Claims, 3 Drawing Sheets

MIXING SHAFT FOR THOROUGH MIXING AND COMMINUTING OF FOOD PRODUCTS

Figure 1:
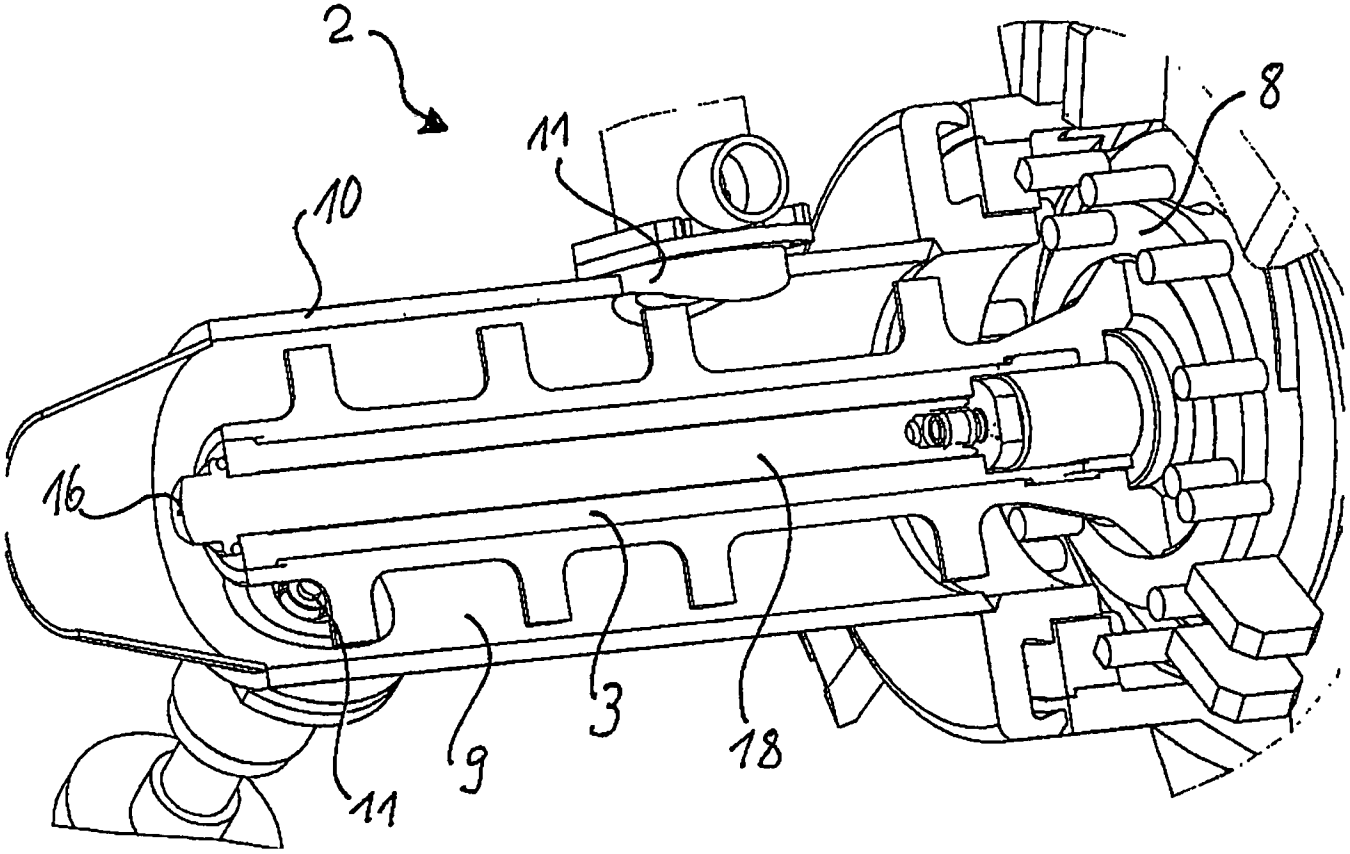

The present invention is concerned with a mixing shaft for mixing through and subdividing of food products in a unit, in particular having a plastic coating on the stainless steel core of the mixing shaft.

Such mixing shafts are known in the state of the art from the German printed Patent document DE 8804492.0. The known mixing shaft exhibits a smooth, round steel core, wherein a jacket is applied to the surface of the steel core, wherein the jacket exhibits flattenings at different locations, and wherein the flattenings serve for the attachment of mixing elements fixed against rotation The mixing shafts are in most cases incorporated into a heating machine of a continuously producing boiler, wherein water vapor having the quality of drinking water is injected through nozzles into the food products, such as for example molten or soft cheese, soups, sauces, in the boiler. Here the mixing shafts are rotated with rotation speeds of 300 to 3000 rotations per minute in the food product. The product has to be subdivided with the mixing shaft for obtaining a surface as large as possible in order to assure an optimum condensation of water vapor at the product particles and therewith an optimum heating up.

The known mixing shafts in the state-of-the-art comprise a stainless-steel core, wherein a plastic coating is applied with different methods on the stainless-steel core and is sealed with sealing rings.

It has been found disadvantageous with the conventional embodiments of the mixing shaft that certain lactose molecules, protein molecules and proteins attach to the surface of the plastic coating and burn off and therewith reduce the standing time of the mixing shaft and the product quality substantially. In addition, the up to now known mixing shafts or, respectively, the plastic coatings of the mixing shafts exhibit an insufficient stability at increased temperatures of about 150 degrees centigrade. Furthermore it is disadvantageous because of hygienic reasons that intermediate spaces between the plastic coating and the metal of the mixing shaft form during operation at increased temperatures because of the different thermal expansion coefficients of plastic and of metals, wherein the food products penetrate into the intermediate spaces and are therefore difficult to clean and to remove.

Therefore, it is a purpose of the present invention to furnish a mixing shaft for food products, wherein the mixing shaft is safe to operate and exhibits a long standing time and is hygienic in its application.

This object is obtained with the characterizing features of the main claims. Further features important for the invention can be gathered from the sub claims.

The structured mixing shaft according to the present invention for mixing and subdividing of food products in a machine is characterized in that a steel core with a structured surface is surrounded by a coating, wherein the coating exhibits mixing elements, wherein the mixing elements are integrated into the coating.

The method for production of a coating on the surface of a steel core of a mixing shaft for mixing and comminuting of food products in an aggregate with the aid of a processing method known in principle for the application of poly-tetra fluoro-ethylene (PTFE) on the surfaces is characterized in that a coating with mixing elements is applied onto the structured surface of the steel core at isostatic pressure (p) and increased temperatures (T).

It is the advantageous that the coating is a so-called poly-tetra fluoro-ethylene (PTFE) material or a ceramic material. It is in addition advantageous that the steel core is made out of stainless-steel.

It is furthermore advantageous that the elongated cylinder section of the mixing shaft exhibits a flange on one end, wherein the mixing shaft is supported with the flange at the further working tools of the aggregate.

It is also advantageous that mixing elements, preferably formed round, are disposed at certain distances (A) on the cylindrical section of the mixing shaft, wherein the distances (A) of the mixing elements are irregular.

The mixing aggregate exhibits a product chamber, wherein at least one injection nozzle is disposed in the chamber wall of the product chamber, wherein a water vapor of drinking water quality is injected through the injection nozzle.

It is further advantageous that the plastic coating is pressed on isostatically at high pressures of from 300 to 350 bar, then sintered at temperatures of from 360 degrees centigrade to 380 degrees centigrade and in the following is processed by metal cutting and machining away. After the plastic coating is applied to the steel core of the mixing shaft, it is advantageous to polish the surface of the plastic coating.

It is furthermore advantageous that the mixing elements are a component of the coating.

It is also advantageous that the cylindrical section of the mixing shaft exhibits elongated grooves and projections, wherein the corners and edges of the grooves and projections are rounded, and wherein the width of the grooves and the width of the projections are of approximately the same size.

Figure 2:
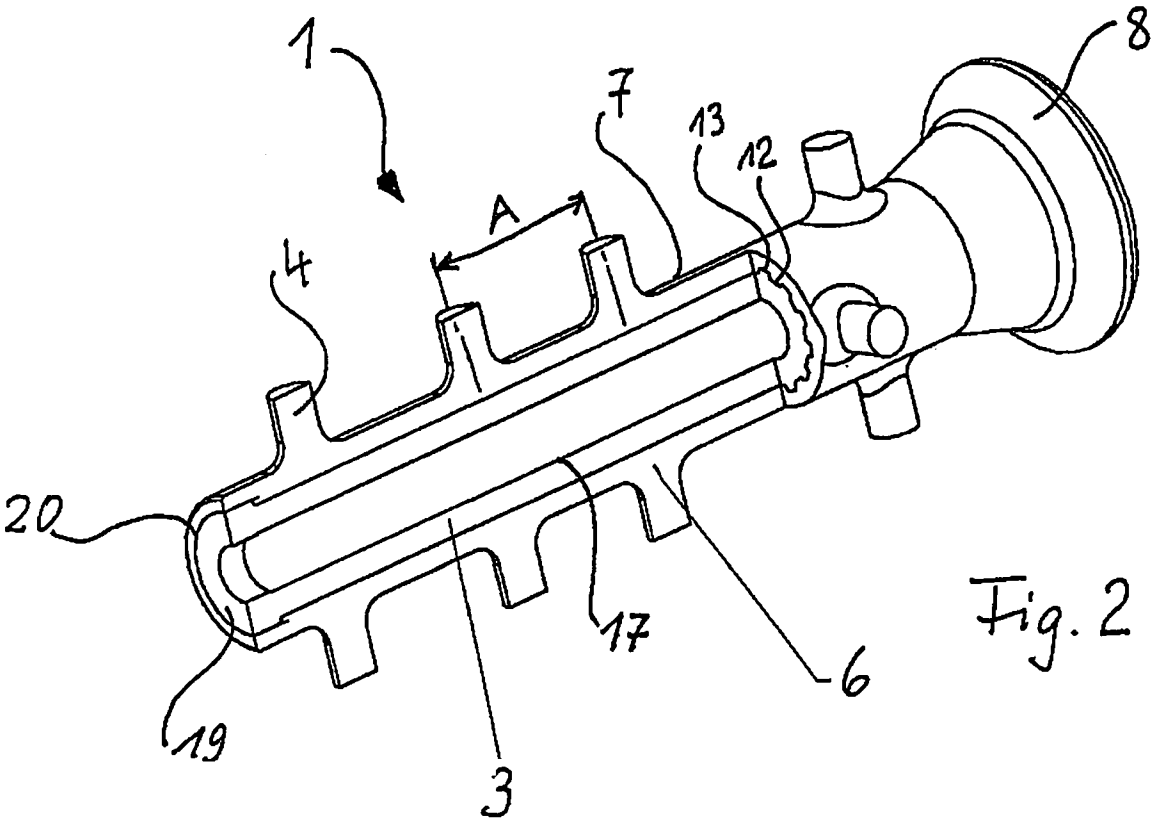
Figure 3:
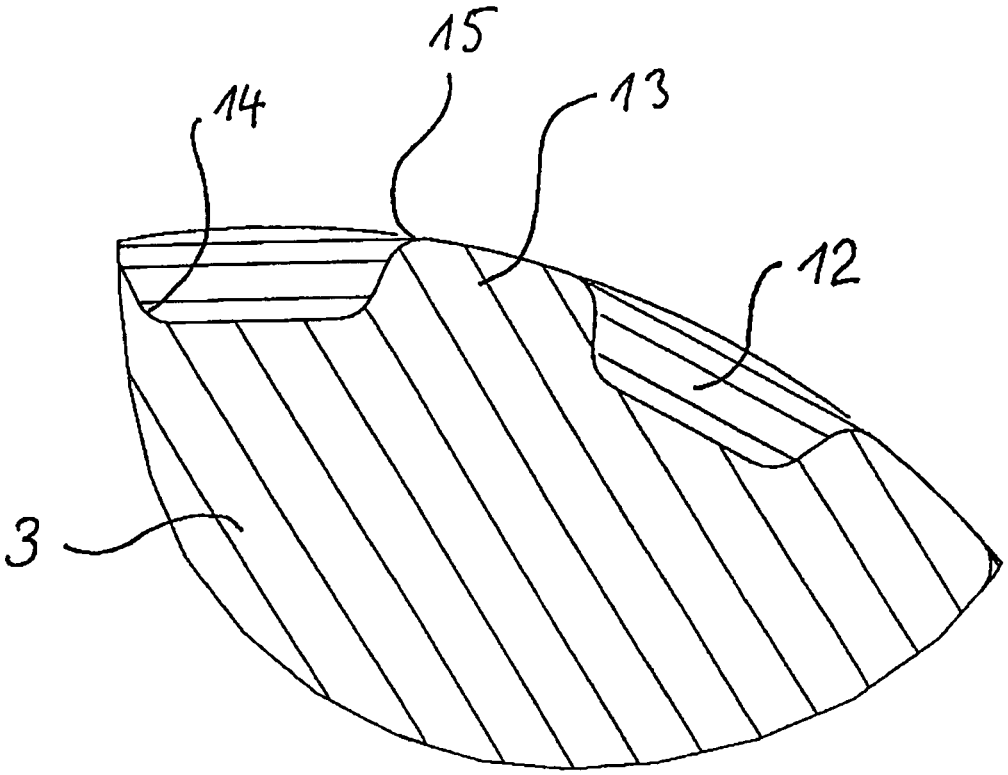

In the following the invention is illustrated in more detail by way of drawings. There is shown in:

FIG. 1: a perspective representation of the mixing aggregate (2) of a plant for mixing and comminuting of food products;

FIG. 2: a perspective illustration of the mixing shaft (1) according to the present invention with the steel core (3) and the plastic coating (6) of the mixing shaft (1);

FIG. 3: a sectional view from the surface of the steel core (3).

FIG. 1 shows a perspective schematic presentation of the aggregate 2, wherein the mixing shaft 1 according to the present invention is incorporated into the aggregate 2. The mixing shaft is described in more detail further below. The mixing shaft 1 exhibits at its one end a further working tool 8, wherein the complete shaft is supported by the further working tool 8. The steel core 3 exhibits an attachment screw 16 at the other end of the mixing shaft 1, wherein the mixing shaft 1 is pressed against the working tool with the attachment screw 16. At least one injection nozzle 11 is disposed in the walls 10 of the product aggregate 2, wherein arbitrary agents are injected into the interior of the product aggregate 2 with the injection nozzle 11. The mixing shaft 1 is driven with rotation speeds of between 300 and 3000 rotations per minute.

FIG. 2 shows a perspective illustration of a partial sectional view of the mixing shaft 1 according to the present invention. The mixing shaft 1 comprises essentially an elongated cylindrical steel core 3, wherein the steel core 3 is surrounded by a plastic coating 6. The steel core 3 exhibits in the middle a bore hole 17, wherein a bolt 18 with a thread (not shown here) is guided in the bore hole 17, and wherein the mixing shaft 1 is pressed with a thread and with the screw 16 against the working tool. Both the surface of the flange as well as also the complete cylindrical section 7 of the steel core 3, with the exception of the front faces 19, are surrounded by a single plastic coating 6. The surface of the plastic coating 6 itself is structured and exhibits in the present embodiment example radially projecting mixing elements 4, wherein the distances (A) of the mixing elements 4 are different and are distributed quasi irregular over the complete surface circumference of the mixing shaft 1. The coating 6 is a so-called poly-tetra fluoro-ethylene (PTFE) coating in the present embodiment example, wherein the poly-tetra fluoro-ethylene is isostatically pressed on at relatively high pressure and is sintered at temperatures between 360 degrees centigrade and 380 degrees centigrade. Generally air gaps form at the boundary faces 20 of the materials between coating and steel core because of the different coefficients of expansion of plastic and steel, wherein the product residues penetrate into the air gaps and cannot any longer be removed. However, a residual tension of the plastic coating 6 on the surface of the steel core 3 remains based on the special connection method of the plastic coating on the steel core 3 of the mixing shaft 1 such that a macroscopic gap formation is practically impossible. The surface of the steel core 3 is formed structured in order to furnish a secure hold and support for the plastic coating 6 on the surface of the elongated part of the mixing shaft 1. The structure out of elongated grooves 12 and elongated projections 13 over a part of the cylindrical section of the steel core 3 is formed in the present embodiment example. The depth of the grooves amounts to about 2 mm and the widths of the grooves 12 and of the projections are between 6 mm and 10 mm. The grooves 12 end shortly in front of the front side of the cylindrical section 7 of the mixing shaft 1, whereby an additional stability against sliding is furnished for the plastic coating 6. Furthermore it is for some embodiment examples advantageous to roughen the surface, with the exception of the front faces, of the cylindrical section of the mixing shaft 1, whereby the plastic coating can penetrate into the pores of the roughening.

The invention claimed is:

1. Structured mixing shaft (1) for thorough mixing and comminution of food products in an assembly (2) comprising a steel core (3);

a coating (6) furnished to the steel core (3);

mixing elements (4) homogeneous with the coating (6), wherein the steel core (3), the coating (6), and the mixing elements (4) form a structured mixing shaft (1) and wherein the coating (6) and the mixing elements (4) consist of the same plastic material;

wherein the cylindrical section (7) of the steel core (3) of the mixing shaft exhibits elongated grooves (12) and elongated projections (13), wherein the corners (14) and the edges (15) of the elongated grooves (12) and of the elongated projections (13) are formed rounded and wherein the coating (6) of the steel core (3) covers the complete steel core (3) including a connection flange and wherein the coating (6) prevents any contact of the steel core (3) with a product to be mixed.

2. Mixing shaft according to claim 1 wherein the coating (6) is a poly-tetra fluoro-ethylene (PTFE) and covers the complete mixing shaft (1) and wherein the mixing elements are made of poly-tetra fluoro-ethylene (PTFE).

3. Mixing shaft according to claim 1 wherein the steel core (3) is made of stainless steel and wherein the stainless steel core (3) has a bore hole (17) in a middle, wherein a bolt (18) having a thread is guided in the bore hole (17), and wherein the mixing shaft (1) is pressed with a thread and with a screw (16) against a working tool.

4. Mixing shaft according to claim 1 wherein an elongated section (7) is furnished, and wherein a flange (8) is arranged at an end of the elongated section (7) and fixed to the end of the elongated section (7).

5. Mixing shaft according to claim 1, wherein a cylindrical elongated section (7) is disposed in an elongated product chamber (9).

6. Mixing shaft according to claim 5, wherein mixing elements (4) are disposed at predetermined distances (A) on the elongated cylindrical section (7).

7. Mixing shaft according to claim 5 wherein mixing elements (4) are disposed at irregular distances (A) on the elongated cylindrical section (7).

8. Mixing shaft according to claim 7 wherein at least one injection nozzle (11) is disposed at the product chamber wall (10).

9. Mixing shaft according to claim 1, wherein the plastic coating (6) and the mixing elements (4), are pressed on isostatically at high pressures, then are sintered at high temperatures and in the following are worked by metal cutting and machining away.

10. Mixing shaft according to claim 1, wherein the surface of the plastic coating (6) is polished.

11. Mixing shaft according to claim 1, wherein the complete surface of the steel core is roughened.

12. Mixing shaft according to claim 1, wherein the plastic coating (6) and the mixing elements (4) are sintered at temperatures from about 360 degrees centigrade to 380 degrees centigrade after the isostatic pressure application.

13. Mixing shaft according to claim 1, wherein the mixing elements (4) are integrated with the coating (6) and are a component of the coating (6).

14. Mixing shaft according to claim 1, wherein the mixing elements (4) are formed as elongated elements radial extending from the steel core (3) of the mixing shaft (1).

* * * * *